US007905716B2

(12) United States Patent
Takeuchi et al.

(10) Patent No.: US 7,905,716 B2
(45) Date of Patent: Mar. 15, 2011

(54) SCROLL COMPRESSOR

(75) Inventors: Makoto Takeuchi, Aichi-ken (JP); Takahide Ito, Aichi-ken (JP); Hiroshi Yamazaki, Aichi-ken (JP); Tetsuzou Ukai, Aichi-ken (JP); Kazuhide Watanabe, Aichi-ken (JP); Katsuhiro Fujita, Aichi-ken (JP); Tomohisa Moro, Aichi-ken (JP); Takayuki Kuwahara, Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 826 days.

(21) Appl. No.: 11/676,073

(22) Filed: Feb. 16, 2007

(65) Prior Publication Data

US 2007/0253853 A1 Nov. 1, 2007

(30) Foreign Application Priority Data

Apr. 28, 2006 (JP) ..... 2006-125558

(51) Int. Cl.
*F03C 2/00* (2006.01)
*F03C 4/00* (2006.01)
*F04C 18/00* (2006.01)

(52) U.S. Cl. ..... 418/55.3; 418/55.2; 418/55.5; 418/57; 464/103; 464/137

(58) Field of Classification Search ..... 418/55.1–55.6, 418/57; 464/102, 103, 137
See application file for complete search history.

(56) References Cited

U.S. PATENT DOCUMENTS

| | | | | |
|---|---|---|---|---|
| 5,542,829 | A * | 8/1996 | Inagaki et al. | 418/55.3 |
| 5,795,141 | A * | 8/1998 | Oki et al. | 418/55.3 |
| 5,807,089 | A * | 9/1998 | Tsumagari et al. | 418/55.3 |
| 6,287,096 | B1 * | 9/2001 | Nakane et al. | 418/55.2 |
| 6,331,102 | B1 | 12/2001 | Takeuchi et al. | |
| 7,217,109 | B2 * | 5/2007 | Takei | 418/55.3 |
| 7,497,674 | B2 * | 3/2009 | Tateishi et al. | 418/55.3 |

FOREIGN PATENT DOCUMENTS

| | | | |
|---|---|---|---|
| CN | 1290329 | | 4/2001 |
| DE | 19928808 | A1 | 12/1999 |
| EP | 0756087 | A1 | 1/1997 |
| JP | 5-321850 | A | 12/1993 |
| JP | 2000-009065 | A | 1/2000 |
| JP | 3028756 | B2 | 2/2000 |
| JP | 2002-180976 | A | 6/2002 |
| JP | 2005-240700 | A | 9/2005 |

OTHER PUBLICATIONS

European Communication for Application No. 07102524.1 issued May 6, 2010.

(Continued)

*Primary Examiner* — Theresa Trieu
(74) *Attorney, Agent, or Firm* — Lowe Hauptman Ham & Berner LLP

(57) ABSTRACT

A scroll compressor includes an orbiting scroll engaged with a front case by pins and rings or ring holes to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The pins, the rings, or the ring holes are shifted in such a direction as to relieve twisting of the orbiting scroll relative to the fixed scroll.

19 Claims, 7 Drawing Sheets

OTHER PUBLICATIONS

Chen, Yu et al. "Mathematical modeling of scroll compressors - part I: compression process modelling" International Journal of Refridgeration, vol. 25, Issue 6, Sep. 2002, pp. 731-750.

Examination Report for Indian Application No. 243/KOL/2007 mailed Sep. 3, 2010.

* cited by examiner

SCROLL COMPRESSOR

RELATED APPLICATIONS

The present application is based on, and claims priority from, Japanese Application Number 2006-125558, filed Apr. 28, 2006, the disclosure of which is hereby incorporated by reference herein in its entirety.

BACKGROUND OF THE INVENTION

1. Field of the Invention

The present invention relates to scroll compressors for use in, for example, air conditioners and refrigerators, and particularly to a scroll compressor having a pin-and-ring rotation-preventing mechanism.

2. Description of Related Art

A scroll compressor having a pin-and-ring rotation-preventing mechanism is disclosed in, for example, Japanese Unexamined Patent Application, Publication No. 5-321850.

This type of scroll compressor undesirably exhibits decreased compression performance as a result of increased compression leakage due to improper engagement between gear surfaces of an orbiting scroll and a fixed scroll if a theoretical orbiting radius $\rho_{th}$ defined by the scrolls (the engagement between the gear surfaces of the orbiting scroll and the fixed scroll) is larger than an orbiting radius $\rho_{pin}$ defined by pins and rings.

The scroll compressor also exhibits decreased compression performance as a result of increased compression leakage due to twisting of the orbiting scroll (rotation relative to the fixed scroll) if the orbiting radius $\rho_{pin}$ defined by the pins and the rings is larger than the theoretical orbiting radius $\rho_{th}$ defined by the scrolls.

BRIEF SUMMARY OF THE INVENTION

In light of the circumstances described above, an object of the present invention is to provide a scroll compressor that can achieve excellent engagement between gear surfaces of fixed and orbiting scrolls and minimize compression leakage to avoid a decrease in compression performance.

To achieve the above object, the present invention provides the following solutions.

A scroll compressor according to the present invention includes an orbiting scroll engaged with a front case by pins and rings or ring holes to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The pins, the rings, or the ring holes are shifted in such a direction as to relieve twisting of the orbiting scroll relative to the fixed scroll.

This scroll compressor can prevent engagement failure between the gear surfaces of the fixed scroll and the orbiting scroll because the orbiting radius is larger than the theoretical orbiting radius.

The scroll compressor can also minimize twisting of the orbiting scroll (rotation relative to the fixed scroll) because the pins, the rings, or the ring holes are shifted in such a direction as to relieve the twisting of the orbiting scroll relative to the fixed scroll.

The scroll compressor can thus provide increased ease of assembly and minimize compression leakage to avoid a decrease in compression performance.

Another scroll compressor according to the present invention includes an orbiting scroll engaged with a front case by pins disposed on an outer end surface of the orbiting scroll and rings or ring holes disposed on an inner end surface of the front case to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The pins are shifted in such a direction as to relieve twisting of the orbiting scroll relative to the fixed scroll.

This scroll compressor can prevent engagement failure between the gear surfaces of the fixed scroll and the orbiting scroll because the orbiting radius is larger than the theoretical orbiting radius.

The scroll compressor can also minimize twisting of the orbiting scroll (rotation relative to the fixed scroll) because the pins are shifted in such a direction as to relieve the twisting of the orbiting scroll relative to the fixed scroll, that is, in the same direction as a direction in which the orbiting scroll orbits.

The scroll compressor can thus provide increased ease of assembly and minimize compression leakage to avoid a decrease in compression performance.

Another scroll compressor according to the present invention includes an orbiting scroll engaged with a front case by pins disposed on an outer end surface of the orbiting scroll and rings or ring holes disposed on an inner end surface of the front case to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The rings or the ring holes are shifted in such a direction as to relieve twisting of the orbiting scroll relative to the fixed scroll.

This scroll compressor can prevent engagement failure between the gear surfaces of the fixed scroll and the orbiting scroll because the orbiting radius is larger than the theoretical orbiting radius.

The scroll compressor can also minimize twisting of the orbiting scroll (rotation relative to the fixed scroll) because the rings or the ring holes are shifted in such a direction as to relieve the twisting of the orbiting scroll relative to the fixed scroll, that is, in the direction opposite to a direction in which the orbiting scroll orbits.

The scroll compressor can thus provide increased ease of assembly and minimize compression leakage to avoid a decrease in compression performance.

Another scroll compressor according to the present invention includes an orbiting scroll engaged with a front case by rings or ring holes disposed on an outer end surface of the orbiting scroll and pins disposed on an inner end surface of the front case to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The pins are shifted in such a direction as to relieve twisting of the orbiting scroll relative to the fixed scroll.

This scroll compressor can prevent engagement failure between the gear surfaces of the fixed scroll and the orbiting scroll because the orbiting radius is larger than the theoretical orbiting radius.

The scroll compressor can also minimize twisting of the orbiting scroll (rotation relative to the fixed scroll) because the pins are shifted in such a direction as to relieve the twisting of the orbiting scroll relative to the fixed scroll, that is, in the direction opposite to a direction in which the orbiting scroll orbits.

The scroll compressor can thus provide increased ease of assembly and minimize compression leakage to avoid a decrease in compression performance.

Another scroll compressor according to the present invention includes an orbiting scroll engaged with a front case by rings or ring holes disposed on an outer end surface of the orbiting scroll and pins disposed on an inner end surface of the front case to prevent rotation of the orbiting scroll. The rings or the ring holes have such an inside diameter that an orbiting radius defined by the pins and the rings or the ring holes is larger than a theoretical orbiting radius defined by engagement between gear surfaces of a fixed scroll and the orbiting scroll. The rings or the ring holes are shifted in such a direction as to relieve twisting of the orbiting scroll relative to the fixed scroll.

This scroll compressor can prevent engagement failure between the gear surfaces of the fixed scroll and the orbiting scroll because the orbiting radius is larger than the theoretical orbiting radius.

The scroll compressor can also minimize twisting of the orbiting scroll (rotation relative to the fixed scroll) because the rings or the ring holes are shifted in such a direction as to relieve the twisting of the orbiting scroll relative to the fixed scroll, that is, in the same direction as a direction in which the orbiting scroll orbits.

The scroll compressor can thus provide increased ease of assembly and minimize compression leakage to avoid a decrease in compression performance.

In the scroll compressors described above, the pins, the rings, or the ring holes are preferably shifted circumferentially in a direction that is the same as or opposite to the direction in which the orbiting scroll orbits.

Such scroll compressors can minimize twisting of the orbiting scroll relative to the fixed scroll to minimize compression leakage and thus a decrease in compression performance.

In the scroll compressors described above, the pins, the rings, or the ring holes are preferably shifted along a tangent to a circle passing through the pins, the rings, or the ring holes in a direction that is the same as or opposite to the direction in which the orbiting scroll orbits.

Such scroll compressors can achieve increased ease of processing and reduced production costs.

Another scroll compressor according to the present invention includes orbiting scroll pins disposed on an outer end surface of an orbiting scroll and front case pins disposed on an inner end surface of a front case. The orbiting scroll pins and the front case pins extend in opposite directions and are engaged with inner circumferential surfaces of common rings to prevent rotation of the orbiting scroll. The rings have such an inside diameter that an orbiting radius defined by the orbiting scroll pins, the front case pins, and the rings is larger than a theoretical orbiting radius defined by engagement between gear surfaces of a fixed scroll and the orbiting scroll. The orbiting scroll pins and the front case pins are shifted in such a direction as to relieve twisting of the orbiting scroll relative to the fixed scroll.

As described above, the present invention can also be applied to a scroll compressor including pins protruding from an orbiting scroll and pins protruding from a front case which are engaged with inner circumferential surfaces of rings to prevent rotation of the orbiting scroll.

The scroll compressors according to the present invention have the advantage of achieving excellent engagement between gear surfaces of fixed and orbiting scrolls and minimizing compression leakage to avoid a decrease in compression performance.

DETAILED DESCRIPTION OF THE INVENTION

Figure 1:
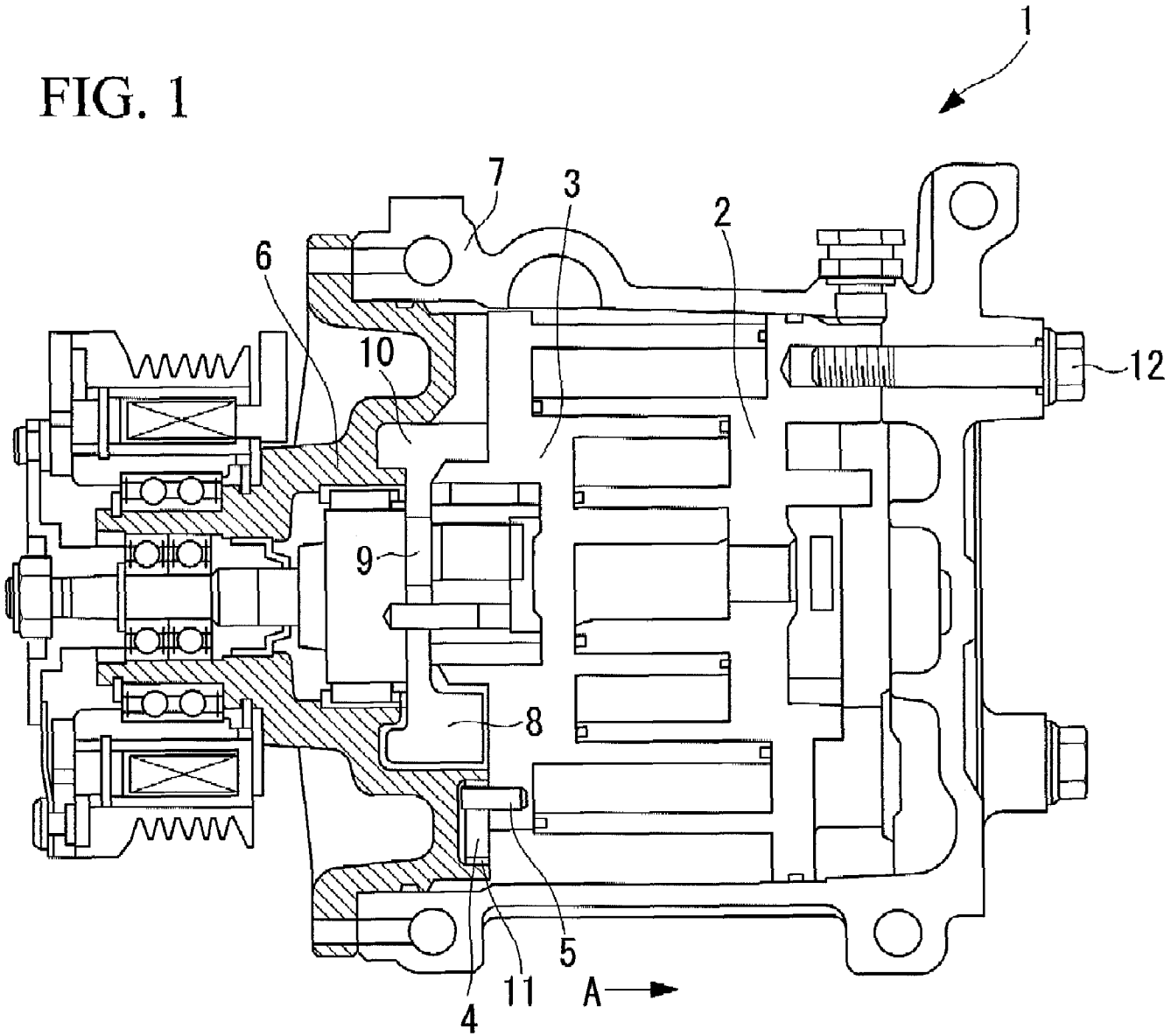
FIG. 1 is a sectional view of a scroll compressor according to a first embodiment of the present invention.
Figure 2:
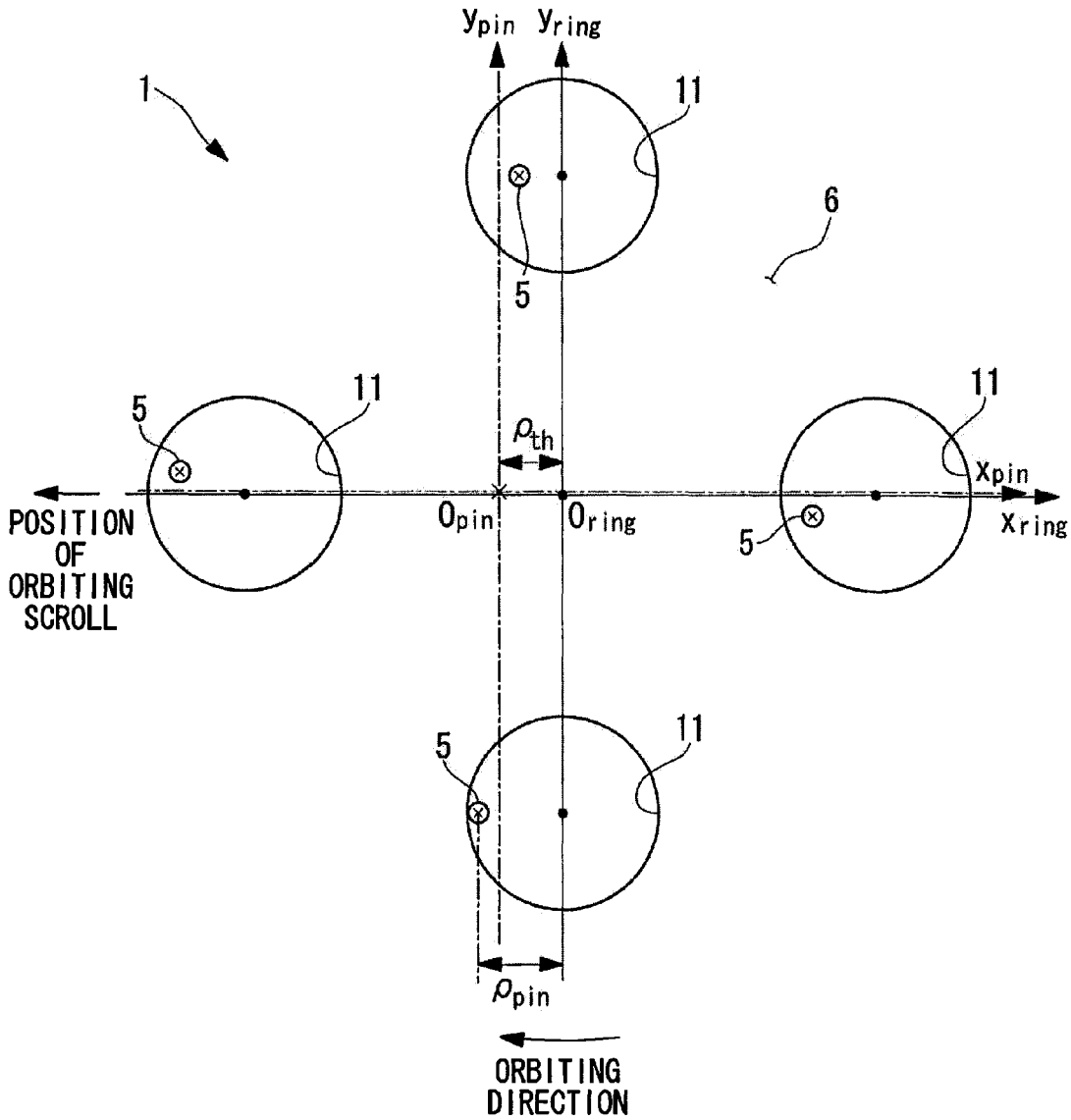
FIG. 2 is a view of the scroll compressor in a direction indicated by arrow A of FIG. 1, showing the relationship between rings disposed on an inner end surface of a front case and pins disposed on an outer end surface of an orbiting scroll.

A scroll compressor according to a first embodiment of the present invention will now be described with reference to FIGS. 1 and 2. FIG. 1 is a sectional view of the scroll compressor according to this embodiment. FIG. 2 is a view of the scroll compressor in a direction indicated by arrow A of FIG. 1, showing the relationship between rings disposed on an inner end surface of a front case and pins disposed on an outer end surface of an orbiting scroll.

In FIG. 1, a scroll compressor 1 includes a fixed scroll 2 fixed to a housing 7 with bolts 12 and an orbiting scroll 3 that orbits without rotating relative to the fixed scroll 2 to compress, for example, a refrigerant.

A front case 6 is fixed to the housing 7 on the outer side of the orbiting scroll 3 (on the left in FIG. 1) to receive a thrust force from the orbiting scroll 3. The front case 6 has ring holes 4 (four ring holes 4 arranged every 90° circumferentially in this embodiment) in an inner end surface of the front case 6 (a substantially annular surface in contact with an outer end surface of the orbiting scroll 3) and rings 11 press-fitted or loosely fitted into the ring holes 4.

Pins 5 protruding from the outer end surface of the orbiting scroll 3 (the surface in contact with the inner end surface of the front case 6) are loosely inserted into the corresponding rings 11. The number of pins 5 corresponds to the number of ring holes 4 (four pins 5 in this embodiment). A crank chamber 10 is defined in the center of the inner side of the front case 6 to accommodate an eccentric shaft 9 and a balance weight 8.

The orbiting scroll 3 engages with the front case 6 via the pins 5 loosely inserted into the rings 11 so as not to rotate while being made to orbit by the eccentric shaft 9. The pins 5 orbit along inner circumferential surfaces of the rings 11 in the same direction as the orbiting scroll 3 does.

In this embodiment, as shown in FIG. 2, the rings 11 and the ring holes 4 have such inside diameters that an orbiting radius $\rho_{pin}$ defined by the rings 11 and the pins 5 is slightly larger than a theoretical orbiting radius $\rho_{th}$ defined by the scrolls 2 and 3 (engagement between gear surfaces of the orbiting scroll 3 and the fixed scroll 2) by a length of, for example, 0.05 to 0.2 mm. In addition, the pins 5 are slightly shifted in a direction opposite to the direction indicated in FIG. 6, that is, circumferentially (along an arc) in the same direction as the direction in which the orbiting scroll 3 orbits, by a distance of, for example, 0.05 to 0.2 mm.

The scroll compressor 1 according to this embodiment can prevent engagement failure between the gear surfaces of the fixed scroll 2 and the orbiting scroll 3 because the orbiting radius $\rho_{pin}$ is larger than the theoretical orbiting radius $\rho_{th}$.

The scroll compressor 1 can also minimize twisting of the orbiting scroll 3 (rotation relative to the fixed scroll 2) because the pins 5 are slightly shifted circumferentially (along an arc) in the same direction as the direction in which the orbiting scroll 3 orbits.

The scroll compressor 1 can thus provide increased ease of assembly and minimize compression leakage to avoid a decrease in compression performance.

Figure 3:
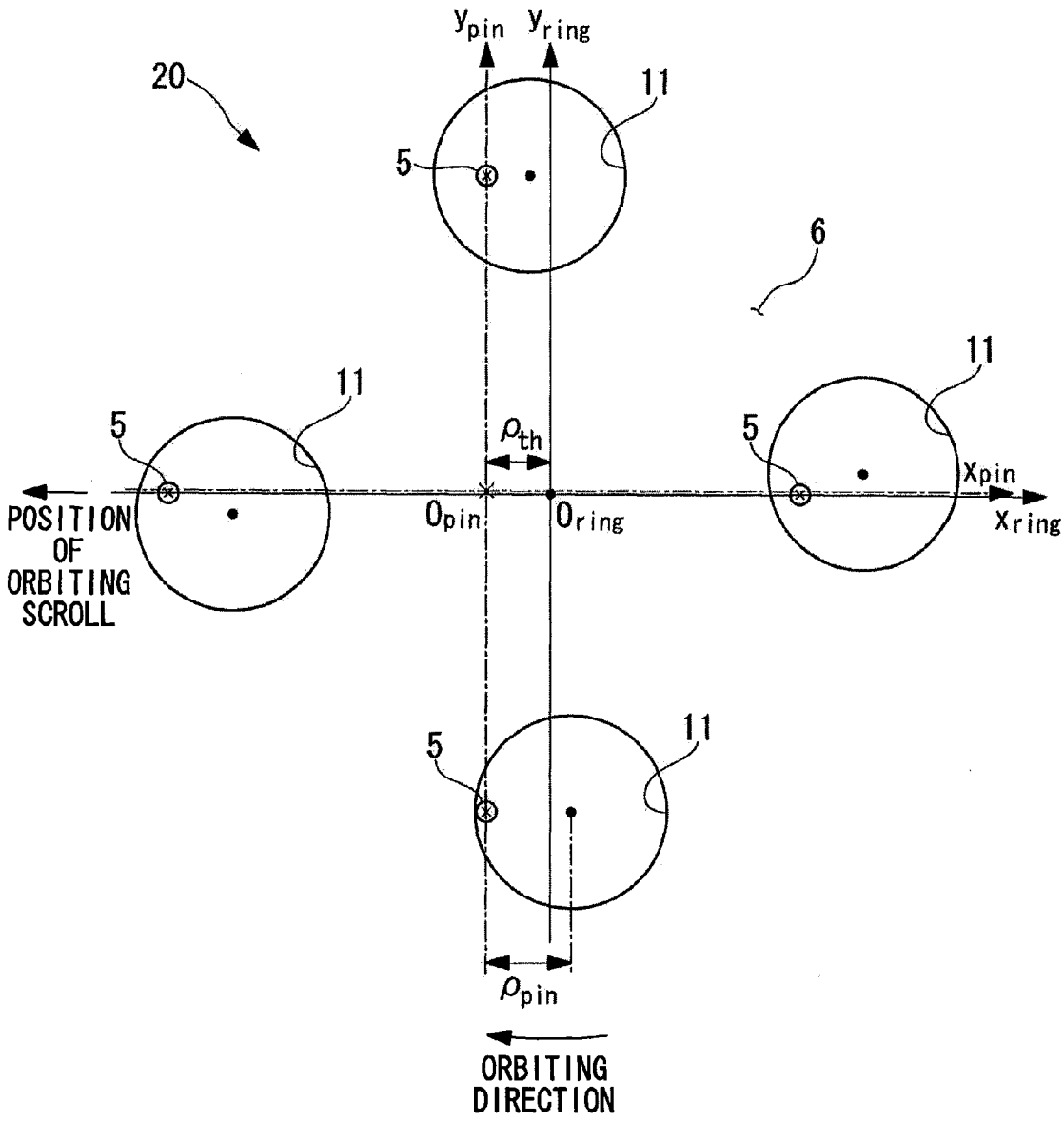
FIG. 3 is a view, similar to FIG. 2, of a scroll compressor according to a second embodiment of the present invention.

A scroll compressor according to a second embodiment of the present invention will be described with reference to FIG. 3, wherein the same reference numerals as used in the first embodiment indicate the same components. A scroll compressor 20 shown in FIG. 3 according to this embodiment differs from the scroll compressor 1 according to the first embodiment as follows. In FIG. 3, the rings 11 and the ring holes 4 have such inside diameters that the orbiting radius $\rho_{pin}$ defined by the rings 11 and the pins 5 is slightly larger than the theoretical orbiting radius $\rho_{th}$ defined by the scrolls 2 and 3 (the engagement between the gear surfaces of the orbiting scroll 3 and the fixed scroll 2) by a length of, for example, 0.05 to 0.2 mm. In addition, the rings 11 and the ring holes 4 are slightly shifted in the direction indicated in FIG. 6, that is, circumferentially (along an arc) in the direction opposite to the direction in which the orbiting scroll 3 orbits, by a distance of, for example, 0.05 to 0.2 mm. The other components are the same as used in the first embodiment and will not be described herein.

The scroll compressor 20 according to this embodiment can prevent engagement failure between the gear surfaces of the fixed scroll 2 and the orbiting scroll 3 because the orbiting radius $\rho_{pin}$ is larger than the theoretical orbiting radius $\rho_{th}$.

The scroll compressor 20 can also minimize twisting of the orbiting scroll 3 (rotation relative to the fixed scroll 2) because the rings 11 and the ring holes 4 are slightly shifted circumferentially (along an arc) in the direction opposite to the direction in which the orbiting scroll 3 orbits.

The scroll compressor 20 can thus provide increased ease of assembly and minimize compression leakage to avoid a decrease in compression performance.

Figure 4:
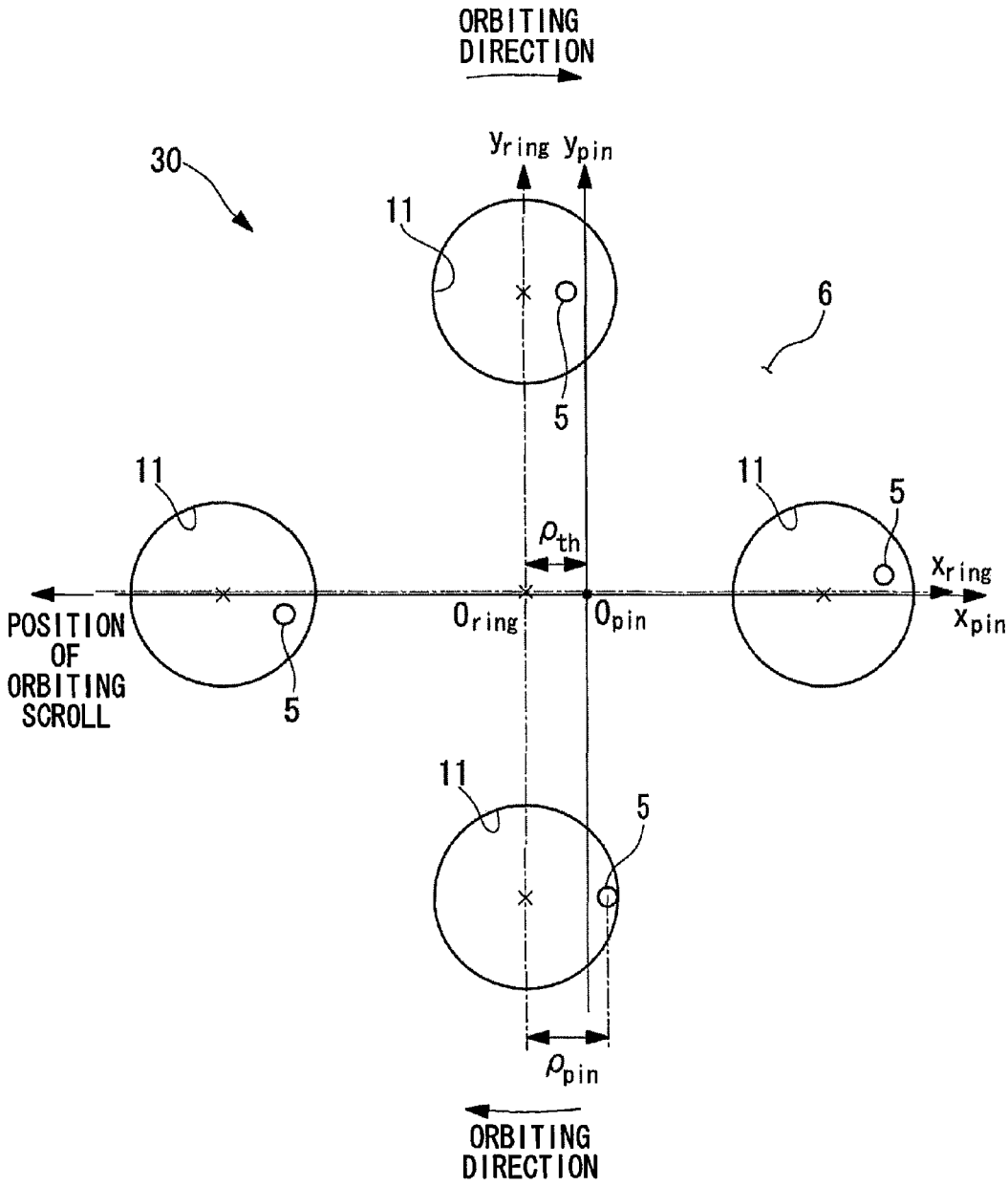
FIG. 4 is a view, similar to FIG. 2, of a scroll compressor according to a third embodiment of the present invention.

A scroll compressor according to a third embodiment of the present invention will be described with reference to FIG. 4, wherein the same reference numerals as used in the previous embodiments indicate the same components. A scroll compressor 30 shown in FIG. 4 according to this embodiment differs from those according to the previous embodiments as follows. In FIG. 4, the scroll compressor 30 has the pins 5 on the inner end surface of the front case 6 and the rings 11 and the ring holes 4 on the outer end surface of the orbiting scroll 3. The rings 11 and the ring holes 4 have such inside diameters that the orbiting radius $\rho_{pin}$ defined by the rings 11 and the pins 5 is slightly larger than the theoretical orbiting radius $\rho_{th}$ defined by the scrolls 2 and 3 (the engagement between the gear surfaces of the orbiting scroll 3 and the fixed scroll 2) by a length of, for example, 0.05 to 0.2 mm. In addition, the pins 5 are slightly shifted in the direction indicated in FIG. 6, that is, circumferentially (along an arc) in the direction opposite to the direction in which the orbiting scroll 3 orbits, by a distance of, for example, 0.05 to 0.2 mm. The other components are the same as used in the previous embodiments and will not be described herein.

The scroll compressor 30 according to this embodiment can prevent engagement failure between the gear surfaces of the fixed scroll 2 and the orbiting scroll 3 because the orbiting radius $\rho_{pin}$ is larger than the theoretical orbiting radius $\rho_{th}$.

The scroll compressor 30 can also minimize twisting of the orbiting scroll 3 (rotation relative to the fixed scroll 2) because the pins 5 are slightly shifted circumferentially (along an arc) in the direction opposite to the direction in which the orbiting scroll 3 orbits.

The scroll compressor 30 can thus provide increased ease of assembly and minimize compression leakage to avoid a decrease in compression performance.

Figure 5:
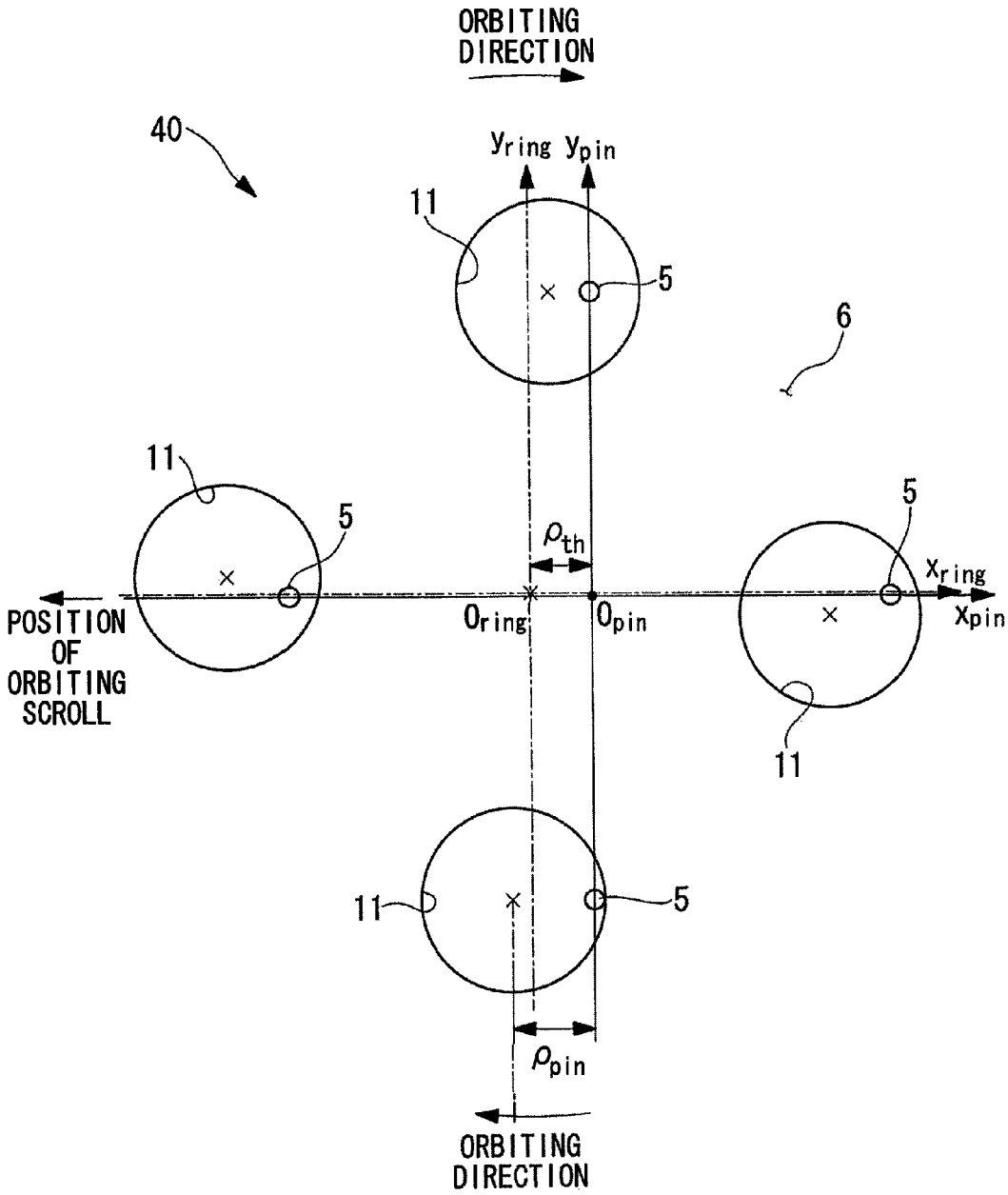
FIG. 5 is a view, similar to FIG. 2, of a scroll compressor according to a fourth embodiment of the present invention.

A scroll compressor according to a fourth embodiment of the present invention will be described with reference to FIG. 5, wherein the same reference numerals as used in the first and second embodiments indicate the same components. A scroll compressor 40 shown in FIG. 5 according to this embodiment differs from those according to the first and second embodiments as follows. In FIG. 5, the scroll compressor 40 has the pins 5 on the inner end surface of the front case 6 and the rings 11 and the ring holes 4 on the outer end surface of the orbiting scroll 3. The rings 11 and the ring holes 4 have such inside diameters that the orbiting radius $\rho_{pin}$ defined by the rings 11 and the pins 5 is slightly larger than the theoretical orbiting radius $\rho_{th}$ defined by the scrolls 2 and 3 (the engagement between the gear surfaces of the orbiting scroll 3 and the fixed scroll 2) by a length of, for example, 0.05 to 0.2 mm. In addition, the rings 11 and the ring holes 4 are slightly shifted in the direction opposite to the direction indicated in FIG. 6, that is, circumferentially (along an arc) in the same direction as the direction in which the orbiting scroll 3 orbits, by a distance of, for example, 0.05 to 0.2 mm. The other components are the same as used in the first and second embodiments and will not be described herein.

The scroll compressor 40 according to this embodiment can prevent engagement failure between the gear surfaces of the fixed scroll 2 and the orbiting scroll 3 because the orbiting radius $\rho_{pin}$ is larger than the theoretical orbiting radius $\rho_{th}$.

The scroll compressor 40 can also minimize twisting of the orbiting scroll 3 (rotation relative to the fixed scroll 2) because the rings 11 and the ring holes 4 are slightly shifted circumferentially (along an arc) in the same direction as the direction in which the orbiting scroll 3 orbits.

The scroll compressor 40 can thus provide increased ease of assembly and minimize compression leakage to avoid a decrease in compression performance.

Figure 6:
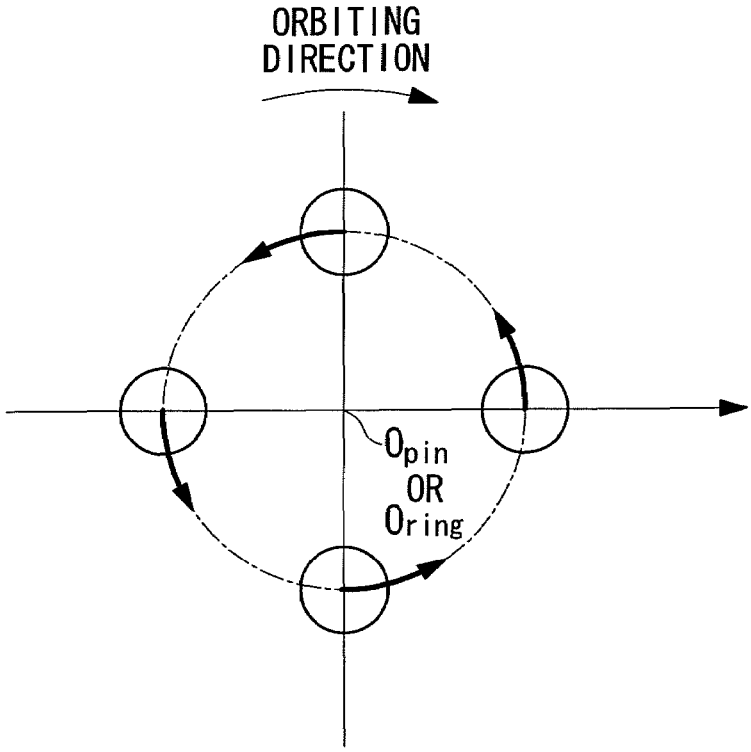
FIG. 6 is a diagram showing a direction in which pins or rings and ring holes are shifted.

The pins 5 or the rings 11 and the ring holes 4 do not necessarily have to be shifted in the direction that is the same as or opposite to the direction indicated in FIG. 6, that is, circumferentially at the same radius in the direction that is the same as or opposite to the direction in which the orbiting scroll 3 orbits. For example, the pins 5 or the rings 11 and the ring holes 4 may be shifted in a direction that is the same as or opposite to the direction indicated in FIG. 7, that is, linearly (along a tangent to a circle passing through the pins 5, the rings 11, or the ring holes 4) in the direction that is the same as or opposite to the direction in which the orbiting scroll 3 orbits.

Figure 7:
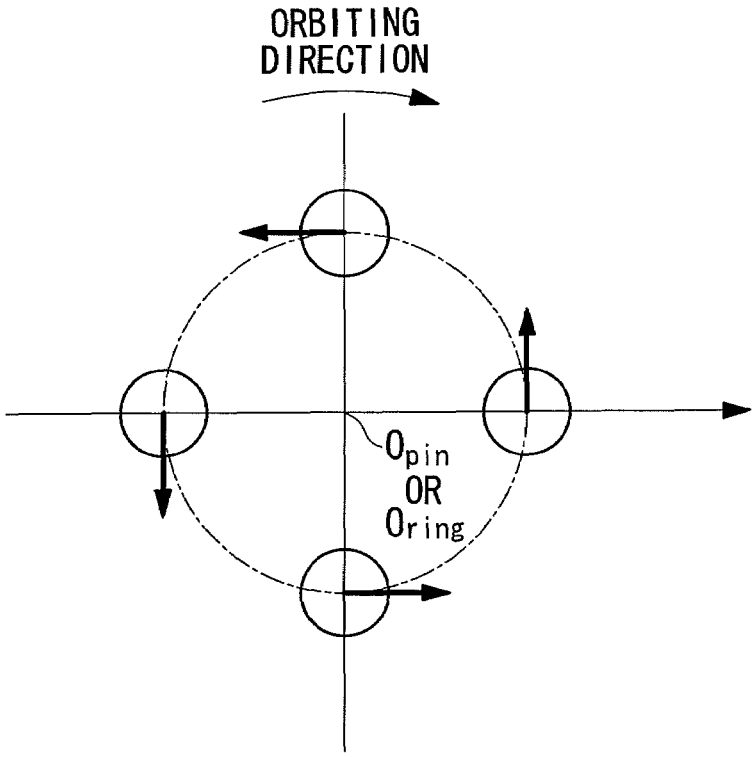
FIG. 7 is a diagram showing a direction in which pins or rings and ring holes are shifted.

If the pins 5 or the rings 11 and the ring holes 4 are shifted as shown in FIG. 7, increased ease of processing and reduced production costs can be achieved.

Either the pins 5 or the rings 11 and the ring holes 4 are shifted in the embodiments described above. However, the present invention is not limited to these embodiments; both the pins 5 and the rings 11 and the ring holes 4 may be shifted.

The four pins 5, the four rings 11, and the four ring holes 4 are provided in the embodiments described above. However, the present invention is not limited to these embodiments; at least three pins 5, at least three rings 11, and at least three ring holes 4 may be provided (for example, five or six).

The rings 11 are press-fitted or loosely fitted into the ring holes 4 in the embodiments described above. However, the present invention is not limited to these embodiments; it may also be applied to the case where the rings 11 are not provided in the ring holes 4, that is, where the pins 5 orbit along the inner circumferential surfaces of the ring holes 4 or the ring holes 4 orbit along the outer circumferential surfaces of the pins 5.

Figure 8:
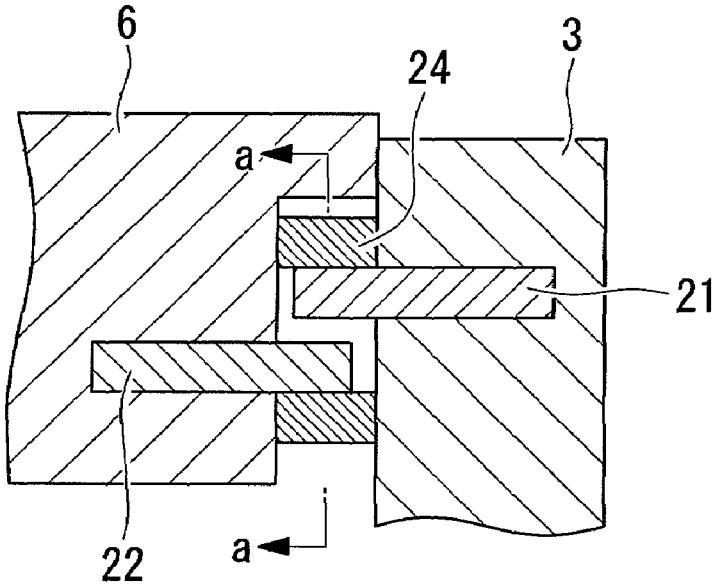
FIG. 8 is a partial sectional view of an end plate of an orbiting scroll and its vicinity.
Figure 9:
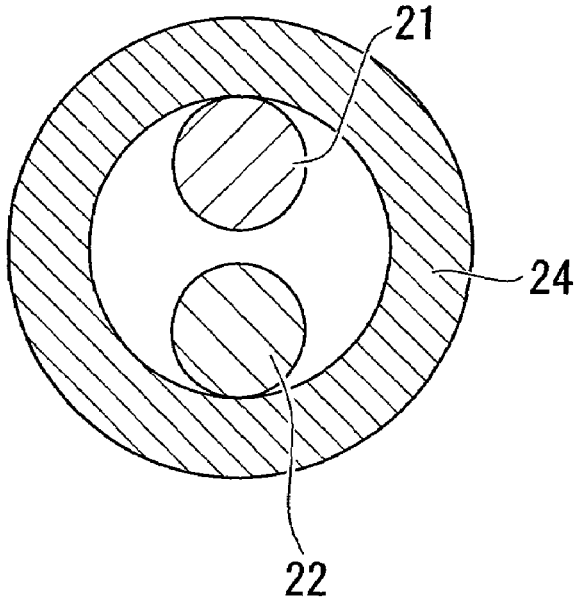
FIG. 9 is a sectional view taken along arrow a-a of FIG. 8.

The present invention may also be applied to a scroll compressor having a rotation-preventing mechanism shown in FIGS. 8 and 9.

FIG. 8 is a partial sectional view of an end plate of the orbiting scroll 3 and its vicinity. Orbiting scroll pins 21 (one of them is shown in FIG. 8) protrude from the outer side of the orbiting scroll 3 while front case pins 22 (one of them is shown in FIG. 8) protrude from the inner side of a wall portion of the front case 6. The orbiting scroll pins 21 and the front case pins 22 extend in opposite directions.

Rings 24 (one of them is shown in FIG. 8) corresponding to the pins 21 and 22 are disposed between the end plate of the orbiting scroll 3 and the front case 6. Each of the rings 24 has one corresponding pair of pins 21 and 22 engaged with the inner circumferential surface thereof (see FIG. 9).

The inside diameter of the rings 24 is determined so that the orbiting radius defined by the rings 24 and the corresponding pairs of pins 21 and 22 is larger than the theoretical orbiting radius defined by the engagement between the gear surfaces of the fixed scroll 2 and the orbiting scroll 3. This prevents engagement failure between the gear surfaces of the fixed scroll 2 and the orbiting scroll 3.

In addition, the pins 21 and 22 are shifted in such a direction as to relieve twisting of the orbiting scroll 3 (rotation relative to the fixed scroll 2), thus minimizing the twisting of the orbiting scroll 3.

What is claimed is:

1. A scroll compressor, comprising:

a fixed scroll;

a front case having inner circumferential surfaces disposed in an inner end surface of the front case;

an orbiting scroll engaged with the front case and configured to orbit the fixed scroll by operation of a driving member; and a single pin paired with each one of the inner circumferential surfaces the single pin engaging the orbiting scroll via the paired circumferential surface of the front case, the paired pins and inner circumferential surfaces configured to prevent rotation of the orbiting scroll;

wherein an orbiting radius, defined by the pins and the inner circumferential surfaces, is larger than a theoretical orbiting radius defined by engagement between gear surfaces of the fixed scroll and the orbiting scroll; and wherein the pins or the inner circumferential surfaces are shifted in a direction as to relieve twisting of the orbiting scroll relative to the fixed scroll.

2. The scroll compressor according to claim 1, wherein the pins or the inner circumferential surfaces are shifted circumferentially in a direction that is the same as or opposite to a direction in which the orbiting scroll orbits.

3. The scroll compressor according to claim 1, wherein the pins or the inner circumferential surfaces are shifted along a tangent to a circle passing through the pins or the inner circumferential surfaces in a direction that is the same as or opposite to a direction in which the orbiting scroll orbits.

4. The scroll compressor according to claim 1, wherein the pins or the inner circumferential surfaces are shifted in such a direction that the pins or the inner circumferential surfaces are shifted circumferentially or tangentially in a direction that is the same as, or opposite to, a direction in which the orbiting scroll orbits so as to relieve twisting of the orbiting scroll relative to the fixed scroll.

5. A scroll compressor comprising:

a fixed scroll;

a front case fixed to the fixed scroll, the front case having inner circumferential surfaces disposed in an inner end surface of the front case;

an orbiting scroll engaged with the front case and configured to orbit the fixed scroll by operation of a driving member; and pins disposed on an outer end surface of the orbiting scroll;

wherein a single pin and one of the inner circumferential surfaces forms a pair, wherein a plurality of pairs of single pins and inner circumferential surfaces engage the orbital scroll with the front case to prevent rotation of the orbiting scroll;

wherein the inner circumferential surfaces have an inside diameter, and an orbiting radius, defined by the pins and the inner circumferential surfaces, is larger than a theoretical orbiting radius defined by engagement between gear surfaces of the fixed scroll and the orbiting scroll; and wherein the pins are shifted in a direction as to relieve twisting of the orbiting scroll relative to the fixed scroll.

6. The scroll compressor according to claim 5, wherein the pins or the inner circumferential surfaces are shifted circumferentially in a direction that is the same as, or opposite to, a direction in which the orbiting scroll orbits.

7. The scroll compressor according to claim 5, wherein the pins or the inner circumferential surfaces are shifted along a tangent to circle passing through the pins or the inner circumferential surfaces in a direction that is the same as, or opposite to, a direction in which the orbiting scroll orbits.

8. The scroll compressor according to claim 5, wherein the pins are shifted in such a direction that the pins are shifted circumferentially or tangentially in a direction that is the same as, or opposite to, a direction in which the orbiting scroll orbits so as to relieve twisting of the orbiting scroll relative to the fixed scroll.

9. A scroll compressor, comprising:

a fixed scroll;

a front case, the front case having inner circumferential surfaces disposed in an inner end surface of the front case;

an orbiting scroll engaged with the front case, the orbiting scroll configured to orbit the fixed scroll by operation of a driving member; and pins disposed on an outer end surface of the orbiting scroll, each of the pins being paired with a different one of the inner circumferential surfaces;

wherein each pin and inner circumferential surface engages the orbiting scroll with the front case, the pairs of pins and inner circumferential surfaces configured to prevent rotation of the orbiting scroll, wherein the inner circumferential surfaces have an inside diameter, and an orbiting radius, defined by the pins and the inner circumferential surfaces, is larger than a theoretical orbiting radius defined by engagement between gear surfaces of the fixed scroll and the orbiting scroll; and wherein the inner circumferential surfaces are shifted in a direction as to relieve twisting of the orbiting scroll relative to the fixed scroll.

10. The scroll compressor according to claim 9, wherein the pins or the inner circumferential surfaces are shifted circumferentially in a direction that is the same as, or opposite to, a direction in which the orbiting scroll orbits.

11. The scroll compressor according to claim 9, wherein the pins or the inner circumferential surfaces are shifted along a tangent to circle passing through the pins or the inner circumferential surfaces in a direction that is the same as, or opposite to, a direction in which the orbiting scroll orbits.

12. The scroll compressor according to claim 9, wherein the inner circumferential surfaces are shifted in such a direction that the inner circumferential surfaces are shifted circumferentially or tangentially in a direction that is the same as, or opposite to, a direction in which the orbiting scroll orbits so as to relieve twisting of the orbiting scroll relative to the fixed scroll.

13. A scroll compressor, comprising:

a fixed scroll;

a front case;

an orbiting scroll engaged with the front case, the orbiting scroll configured to orbit the fixed scroll by operation of a driving member; and inner circumferential surfaces disposed on an outer end surface of the orbiting scroll and pins disposed on an inner end surface of the front case, wherein each of the pins is associated with a different one of the inner circumferential surfaces, forming a pair of a single pin and a single inner circumferential surface, the pairs of pins and inner circumferential surfaces engaging the orbiting scroll with the front case;

wherein the pairs of pins and inner circumferential surfaces are configured to prevent rotation of the orbiting scroll;

wherein the inner circumferential surfaces have an inside diameter wherein an orbiting radius defined by the pins and the inner circumferential surfaces is larger than a theoretical orbiting radius defined by engagement between gear surfaces of the fixed scroll and the orbiting scroll; and wherein the pins are shifted in a direction as to relieve twisting of the orbiting scroll relative to the fixed scroll.

14. The scroll compressor according to claim 13, wherein the pins or the inner circumferential surfaces are shifted circumferentially in a direction that is the same as, or opposite to, a direction in which the orbiting scroll orbits.

15. The scroll compressor according to claim 13, wherein the pins or the inner circumferential surfaces are shifted along a tangent to circle passing through the pins or the inner circumferential surfaces in a direction that is the same as, or opposite to, a direction in which the orbiting scroll orbits.

16. The scroll compressor according to claim 13, wherein the pins are shifted in such a direction that the pins are shifted circumferentially or tangentially in a direction that is the same as, or opposite to, a direction in which the orbiting scroll orbits so as to relieve twisting of the orbiting scroll relative to the fixed scroll.

17. A scroll compressor, comprising:

a fixed scroll;

a front case;

an orbiting scroll engaged with the front case and configured to orbit the fixed scroll by operation of a driving member; and inner circumferential surfaces disposed on an outer end surface of the orbiting scroll and pins disposed on an inner end surface of the front case, wherein each of the inner circumferential surfaces is paired with a different one of the pins, wherein the pairs of pins and inner circumferential surfaces engage the orbiting scroll with the front case to prevent rotation of the orbiting scroll;

wherein the inner circumferential surfaces have an inside diameter, wherein an orbiting radius, defined by the pins and the inner circumferential surfaces, is larger than a theoretical orbiting radius defined by engagement between gear surfaces of the fixed scroll and the orbiting scroll; and wherein the inner circumferential surfaces are shifted in such a direction as to relieve twisting of the orbiting scroll relative to the fixed scroll.

18. The scroll compressor according to claim 17, wherein the pins or the inner circumferential surfaces are shifted circumferentially in a direction that is the same as, or opposite to, a direction in which the orbiting scroll orbits.

19. The scroll compressor according to claim 17, wherein the pins or the inner circumferential surfaces are shifted along a tangent to circle passing through the pins or the inner circumferential surfaces in a direction that is the same as, or opposite to, a direction in which the orbiting scroll orbits.

* * * * *